US007798454B2

(12) United States Patent
Stoller

(10) Patent No.: US 7,798,454 B2
(45) Date of Patent: Sep. 21, 2010

(54) STRUCTURAL SUPPORTS

(76) Inventor: Evan Stoller, 19 Central Sq., Chatham, NY (US) 12037

( * ) Notice: Subject to any disclaimer, the term of this patent is extended or adjusted under 35 U.S.C. 154(b) by 688 days.

(21) Appl. No.: 11/503,724

(22) Filed: Aug. 14, 2006

(65) Prior Publication Data

US 2007/0074481 A1 Apr. 5, 2007

Related U.S. Application Data

(60) Provisional application No. 60/708,166, filed on Aug. 15, 2005.

(51) Int. Cl.
*F16M 11/20* (2006.01)
*E04C 5/08* (2006.01)

(52) U.S. Cl. ..... 248/188.1; 248/188.8; 52/223.8; 108/132

(58) Field of Classification Search ..... 248/188.1, 248/188.8, 188.91; 52/745.17, 223.8, 223.14, 52/837, 838; 108/131, 132
See application file for complete search history.

(56) References Cited

U.S. PATENT DOCUMENTS 1,320,072 A * 10/1919 Long ..... 52/846
1,988,081 A * 1/1935 Kemper ..... 52/647
2,857,833 A * 10/1958 Rolf ..... 172/710
3,339,503 A * 9/1967 Flodell ..... 108/158
3,796,169 A * 3/1974 Bales et al. ..... 108/116
4,197,652 A * 4/1980 Qurnell et al. ..... 33/553
4,444,124 A * 4/1984 Burr ..... 108/131
4,846,433 A * 7/1989 Courtois et al. ..... 248/235
6,923,410 B2 * 8/2005 Chang ..... 248/188.5
7,216,467 B2 * 5/2007 Pott ..... 52/745.17

* cited by examiner

*Primary Examiner*—Anita M King
(74) *Attorney, Agent, or Firm*—Gottlieb, Rackman & Reisman, PC

(57) ABSTRACT

A support structure for use in tables and the like comprises a short I-beam segment having a top section, a bottom section and a center section joining the top and bottom sections. Each of the top and bottom sections has two flanges which are preferably stabilized with tension rods. In a preferred embodiment, the bottom section of the I-beam segment is bolted or otherwise secured to a base to form a strong upright support assembly. When utilized to form a trestle-like assembly, such as a table frame, two or more vertical supports are bolted to two or more stretcher bars spanning the vertical supports. In an alternative embodiment, transverse support bars are bolted or otherwise secured to the top of the stretcher bars and a tabletop surface may be secured thereto.

23 Claims, 6 Drawing Sheets

STRUCTURAL SUPPORTS

This application claims the priority date of U.S. provisional patent application Ser. No. 60/708,166 filed on Aug. 15, 2005, which is hereby incorporated herein by reference.

FIELD OF THE INVENTION

This invention relates to improved structural supports. This invention further involves improved support assemblies for trestle-like structures having a plurality of vertical and horizontal supports. Even more particularly, this invention relates to an improved structural support for tables and other consumer items that incorporate support elements for strength and stability.

BACKGROUND OF THE INVENTION

Conventional tables and other items bearing supportive trestle-type configurations, wherein a generally flat planar surface is supported by and spans two or more upright support structures, are typically composed of many joined elements. Although relatively light in weight, such items are often weak, providing insufficient strength and stability to withstand continued use and considerable weight loads.

Tables and other items that bear loads on their surfaces typically have at least one upright or vertical support that comprises a lower base for supporting the table on the ground and an upper platform on which a planar surface rests. Particularly in the context of vertical supports of wooden construction, the lower base and upper platform are connected to one another by a center portion. Both the lower base and upper platform at the ends of the vertical support typically incorporate an increased surface area relative to the center portion. The increased surface areas at the lower base and upper platform allow the forces associated with the weight of the table itself, as well as those of external items placed on a table, to spread across the larger surface area and help ease the tension and stress to any one given area. Despite these design efforts which are intended to provide long-lasting and increased durability and stability, conventional tables, support stands and the like may buckle or bend over time after prolonged normal use, causing them to wobble, progressively lean to one side, or collapse. Buckling or bending is typically the culprit in the vicinity of the upright support, while breaking of the planar surface typically occurs when its critical stress level is reached prior to that of the upright support.

In order to compensate for decreased strength to the vertical supports of tables and related structures, horizontal or diagonal brace elements may be disposed between the vertical supports. In the context of a conventional table, the horizontal and/or diagonal braces disposed between the uprights tend to interfere with a user's legs, thereby making it cumbersome to sit adjacent to the table in an optimal position. Another shortcoming is that with the addition of other supporting elements, additional costs tend to follow due to the increased labor and time needed to fabricate such items.

SUMMARY OF THE INVENTION

Accordingly, it is a principal objective of the present invention to provide strong, durable and stable support structures for use in tables, consumer items and the like which incorporate upright supportive elements.

A further objective of the present invention is to provide support structures for tables and the like that do not wobble, buckle or bend even after prolonged normal use.

Another objective of the present invention is to provide support structures for use in tables and the like which do not require horizontal and/or diagonal braces that interfere with use.

A still further objective of the present invention is to provide support structures for use in tables and the like which are relatively inexpensive to fabricate.

A yet further objective of the present invention is to provide a trestle assembly that can be used as a frame or skeleton for tables and the like.

Additional objectives will be apparent to those skilled in the art from the description of the invention as contained herein.

In its broadest aspects, the invention involves improved support structures. Preferably, the support structures are incorporated into tables and other similar consumer items. In a preferred embodiment, a support structure comprises a short segment of a standard mill-rolled, steel I-beam. The conventional I-beam segment comprises a top section, a bottom section and a center section joining the top and bottom sections. The I-beams and segments thereof that are preferably employed in connection with the invention include an S-section I-beam having tapered flanges, or a wide-flange I-beam having non-tapered and thicker flanges. Each of the top and bottom sections has two flanges which are stabilized with rods, ties or struts. In a preferred embodiment, the bottom section of the I-beam is bolted or otherwise secured to a base to form a strong upright support assembly.

When utilized to form a trestle-like assembly, such as a table frame, two or more vertical supports are bolted to at least one, and preferably two or more stretcher bars spanning the vertical supports. A rigid planar tabletop surface (when provided) is supported directly by the stretcher bars. In an alternative embodiment, transverse support bars are bolted or otherwise secured to the top of the stretcher bars and the tabletop surface is placed or secured thereto.

Additional embodiments of the vertical supports and the trestle assemblies that incorporate the vertical supports, having varying configurations are provided in more detail below.

BRIEF DESCRIPTION OF THE DRAWINGS

Detailed features of the construction are described below with reference to the accompanying drawings, in which.

DETAILED DESCRIPTION OF THE INVENTION

Figure 1:
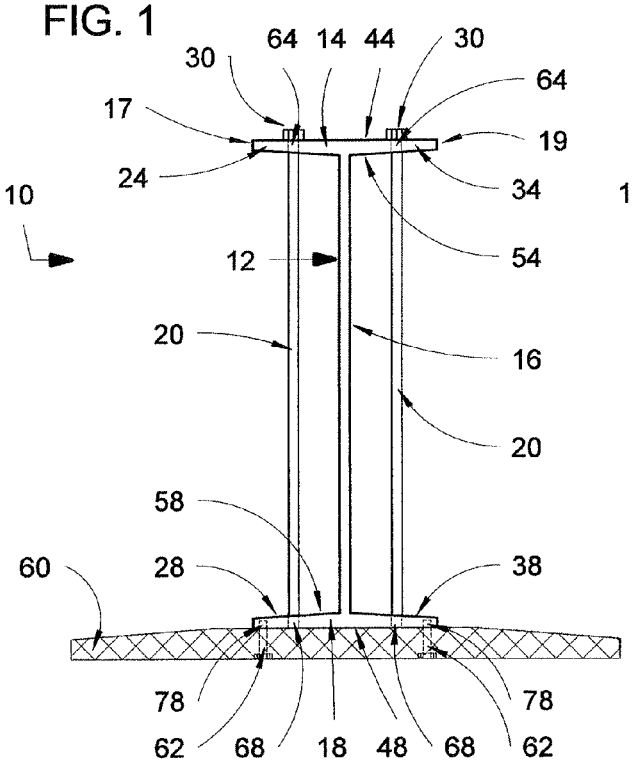
FIG. 1 depicts a front (and back) elevation view of a preferred embodiment of the vertical support assembly with parallel tension rod stabilizers.
Figure 2:
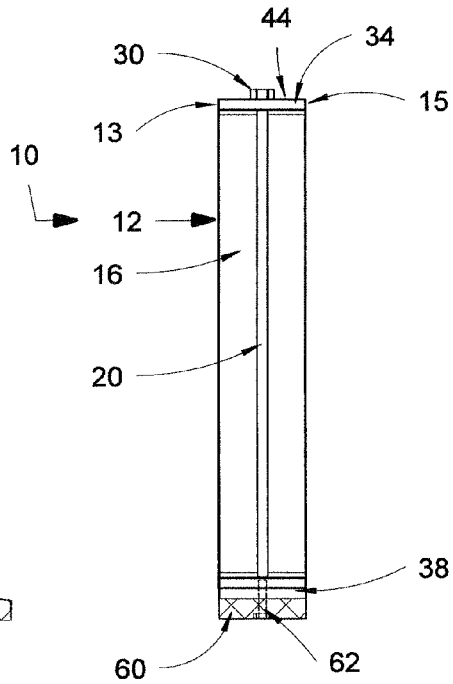
FIG. 2 depicts a side elevation view of the support assembly shown in FIG. 1.
Figure 3:
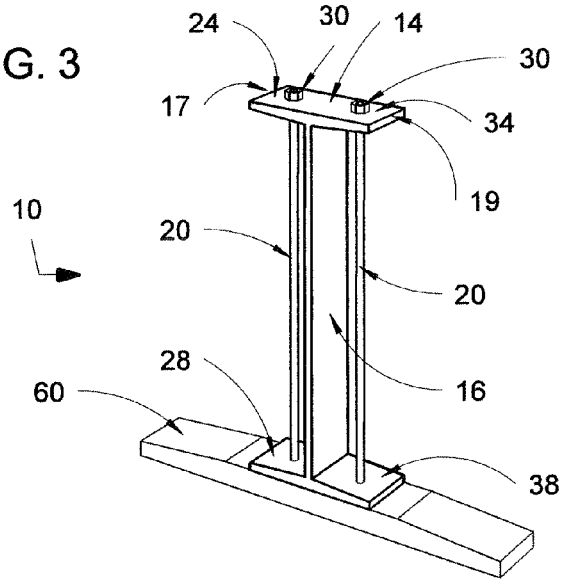
FIG. 3 depicts a perspective view of the support assembly shown in FIG. 1.

Referring to the drawings, FIGS. 1-3 depict a preferred embodiment of a vertical support structure 10 of the present invention. The vertical support structure 10 comprises a short I-beam segment 12 of a standard mill-rolled, steel I-beam, approximately 4½ inches in length, measured from the front to rear edges 13, 15 of the top section 14. The I-beam segment 12 comprises a top section 14, a bottom section 18 and a web or center section 16 joining the top section 14 and bottom section 18. The top section 14 has two flanges 24, 34 and the bottom section 18 has two flanges 28, 38. The I-beam segment 12 is stabilized with steel tension rods 20 positioned on both sides of the center section 16, and running parallel thereto and to one another, primarily to prevent bending or buckling of center section 16 of the I-beam segment 12. The rods 20 may also help stabilize the flanges 24, 34, 28, 38 although they generally are more stable. Preferably, the I-beam segment is 24 inches in height, but I-beams of increased or decreased heights may be used instead as desired. Also, the thickness of the center section is about ½ inch, but the thickness may be varied as well.

The beam segment 12 has a vertical orientation, with the center section 16 perpendicular to the floor and the exterior (i.e., upper) surface 44 of the top section 14 and the exterior (i.e., lower) surface 48 of the bottom section 18 parallel to the floor when in use. In a preferred embodiment, the top section 14, including the flanges thereof 24, 34, is approximately 9 inches in width or twice the longitudinal dimension (i.e., length) of the I-beam segment 12. Likewise, the bottom section 18, including the flanges 28, 38 thereof, has the same width dimension. For reference purposes, the width dimension is measured as the distance between the opposed lateral edges 17, 19 of the top flanges 24, 34, while the length dimension is measure as the distance between the opposed front and rear edges 13, 15.

In the embodiment of the support structure shown in the figures, the flanges 24, 34, 28, 38 of the I-beam segment 12 are thicker near the center section 16 where the center section 16 meets the top and bottom sections 14, 18, and taper to a decreased thickness as they extend away from the center section. In connection with this type of I-beam segment 12, the top and bottom sections 14, 18 appear to be triangular (i.e., isosceles), meeting the center section 16 at a midpoint opposite the base of the triangle. Further, since the interior surfaces 54, 58 of the top and bottom flanges 34, 28, respectively, are tapered on either side of the center section 16, the I-beam segment 12 forms what is also known as an S-section. However, it should be understood that I-beams with non-tapered flanges may be utilized as well in connection with the invention. Alternatively, a wide-flange beam segment (as discussed below in more detail), preferably of a shorter length, with thicker and/or wider flanges may be utilized in connection with the invention as well.

While the center web section 16 resists downward compression on its own, it must be stabilized to further resist lateral forces that result in bending of the I-beam segment 12. Stabilizing means, such as tension ties 20, preferably comprised of ½-inch diameter round, steel rods, are attached between the flanges 24, 28 and 34, 38 on both sides of the center section 16 of the beam segment 12. Preferably, the tension ties 20 pass through the center of the flanges 24, 34 at the top section 14 and the flanges 28, 38 of the bottom section, through correspondingly-sized apertures 64, 68 drilled in the flanges 24, 34, 28, 38 of the I-beam segment 12. At the bottom section 18, the rods 20 are peened to prevent them from pulling through the apertures in the flanges 28, 38. Conversely, at the top section 14, the rods 20 are threaded for approximately a ½ inch of their respective lengths, and nuts 30 are applied the threaded areas of the rods 20 at the exterior surface 44 of the flanges 24, 34 to provide tension.

Since a minimal amount of tension is required to stabilize the I-beam segment 12, a tension tie or stabilizing member having a reduced diameter or thickness could be employed instead of the ½ inch diameter rods of the preferred embodiment. Likewise, thicker tension ties, or a combination of tension ties having varying degrees of thickness may be utilized as well.

At the center of flanges 28, 38 of the bottom section 18, apertures 78 are provided at least partially through the flanges 28, 38 approximately a ½ inch deep from the exterior surface 48 of the bottom section 18. These apertures 78 are preferably correspondingly sized and threaded to receive ⅜-inch bolts. A base or support foot 60 is attached to the bottom section 18 by the bottom flanges 28, 38 thereby providing lateral stability. Preferably, the support foot 60 is secured with at least two ⅜-inch bolts 62, but other conventional securing means may be utilized as well. The heads of the bolts 62 are sunken into the bottom of the support foot 60 which is preferably 27 inches wide. The weight of the steel I-beam steel beam segment 12 (and rods 20) contributes to the stability of the vertical support assembly 10.

Figure 4:
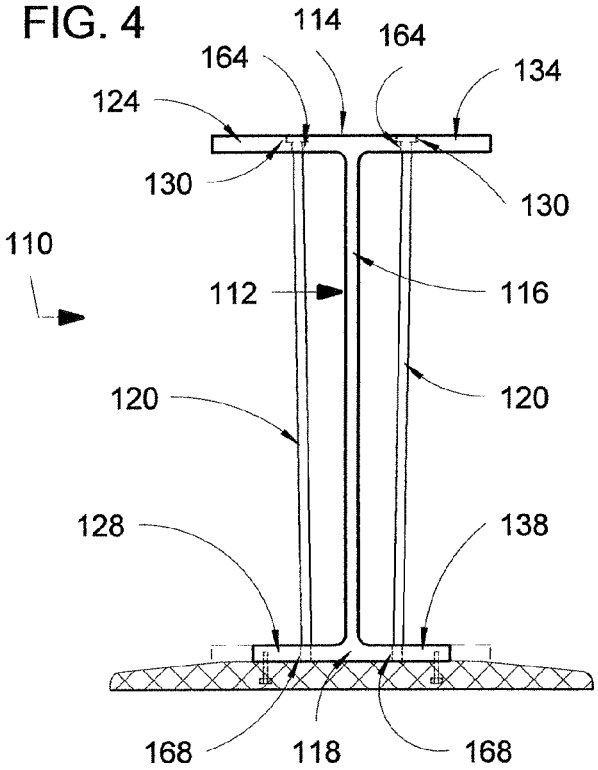
FIG. 4 depicts a front (and back) elevation view of a second preferred embodiment of the vertical support assembly with canted tension rod stabilizers.
Figure 5:
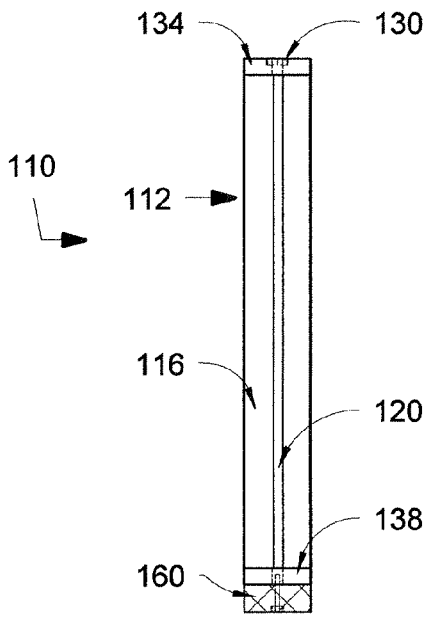
FIG. 5 depicts a side elevation view of the support assembly shown in FIG. 4.
Figure 6:
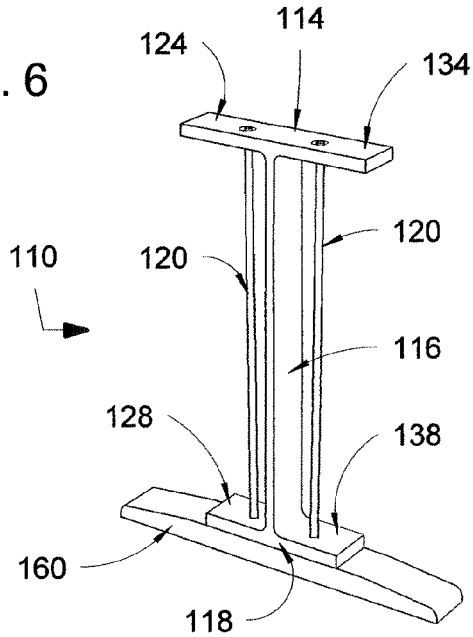
FIG. 6 depicts a perspective view of the support assembly shown in FIG. 4.

Referring again to the drawings, FIGS. 4-6 depict a second embodiment of a vertical support structure 110 of the present invention. In this embodiment, a wide-flange I-beam segment 112 is provided, having a shorter length than the aforementioned I-beam segment 12, preferably about 3 inches, but with flanges 124, 134 at the top section 114 that are preferably thicker and/or which extend further outward from the center section 116, as compared to the flanges 24, 34 of the aforementioned vertical support 10. In this embodiment of the support structure 110, the lower flanges 128, 138 of the bottom section 118, can be of the same or different widths than that of the upper flanges 124, 134, and in this embodiment are shown to have a lesser width, with dotted lines in FIG. 4 showing an equivalent width. The height of the beam segment 112 remains close to the 24-inch height of the former beam segment 12.

At the bottom section 118, the flanges 128, 138 are bolted to a solid 6061-T6 high-strength aluminum tapered floor support foot 160. The overall structure of the vertical support assembly 110 is generally similar to that shown in the embodiment of FIGS. 1-3. The web or center section 116 of wide-flange I-beam segment 112 is slightly thicker than that of the I-beam segment 12, and the thickness (i.e., height) of each flange 124, 134, 128, 138 is preferably greater than that of the I-beam segment 12 as well. As mentioned above, the width of the top section 114 and bottom section 118 is significantly greater than that of the corresponding sections 14, 18 of the vertical support structure 10. Unlike the flanges 24, 34, 28, 38 of the vertical support structure 10, the flanges 124, 134, 128, 138 of this embodiment of the vertical support structure 110 are preferably untapered, having a uniform thickness (i.e., height) along the width of the flanges 124, 134, 128, 138.

The "widened" assembly and increased thickness, particularly in the upper flanges 124, 134, effectively support stretcher bars (discussed in more detail below) that are positioned at greater distances from the center section 116 which is also the axial center of the upright support 110. Furthermore, when transverse support bars are provided (also discussed in more detail below) atop the stretcher bars, they bridge over a greater distance, reducing the cantilever length from the stretcher bars, thus reducing the strain thereto.

As alluded to above, the lower flanges 128, 138 of this embodiment have a width dimension equivalent that of the lower flanges 28, 38 of the vertical support 10 and less than that of the corresponding upper flanges 124, 134. In cutting or otherwise reducing the width of the flanges 128, 138, weight is saved while maintaining the ridged connection at the joint of the bottom section 118 and the support foot 160.

Another difference in this embodiment of the vertical support 110, is that the dimensions of the stabilizing rods 120 are somewhat smaller in diameter and thickness. Rods 120 of reduced diameter, such as 7/16-inch or thinner, may be used since the beam flanges 124, 134, 128, 138 are generally heavier and more sturdy, thus allowing a greater amount of tension and force to be applied prior to bending or buckling of the support 110. However, when thin rods are used under low tension, the rods can be damaged more easily (i.e., bent) in use.

A further difference is that the stabilizing rods 120 of the present embodiment are, from top to bottom, canted slightly inward toward the center section 116 to resist that lateral resonance that exists. Thus, to counter the resonance, the tension rods 120 are attached at the bottom section 118 at a point closer to the center section 116 and continue to a point on the top section 114 that is further from the center section 116 forming a subtle V-shaped profile as shown most clearly in FIG. 4. A 1-degree offset from the vertical center section 116 is shown in FIGS. 4 through 6, however, greater offsets may be instituted as well, limited only by the width the flanges 124, 134 and the maximum angle that may be formed between a tension rod 120 and the center section 116. Likewise, since it is the non-parallel orientation of the support rods 120 which resist the conditions causing resonance, reversing the orientation of the support rods 120 so that an A-shaped profile is formed, provides another means to dampen the resonance of the assembly.

In this embodiment, the tension rods 120 are threaded at both ends and attached to the lower flanges 128, 138 by means of threaded apertures 164, 168 in the flanges 124, 134, 128, 138. At the top flanges 124, 134, the tension rods 120 pass through the apertures 164 and are secured by nuts 130 bearing on the top surface 144 of the top section 114. Both the threaded apertures 164, 168 are drilled or otherwise provided at the 1-degree offset. To achieve solid bearing at the top flanges 124, 134, the tensioning nuts 130 are set in counterbored apertures that are set into the top section 114, preferable at the same 1-degree offset.

Figure 7:
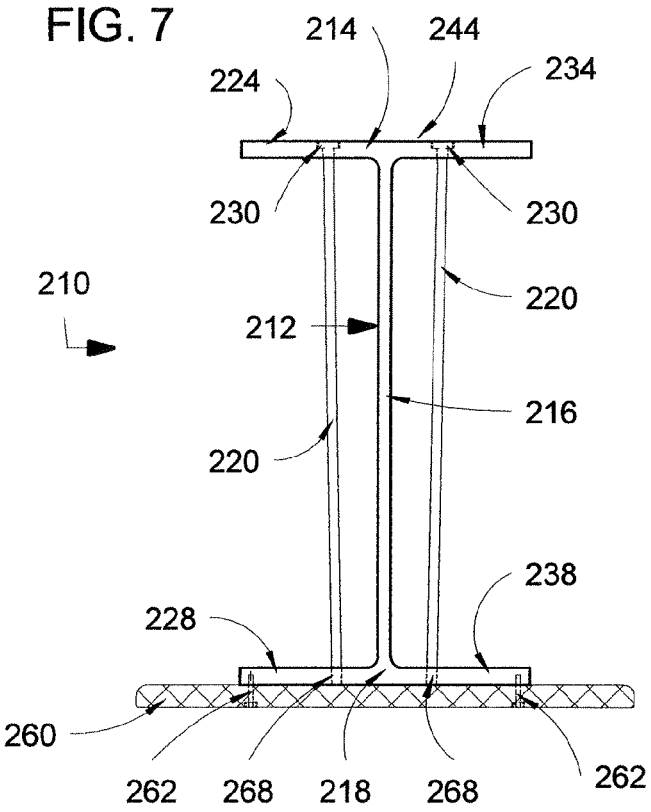
FIG. 7 depicts a front (and back) elevation view of a third embodiment of the vertical support assembly with different flange dimensions and canted tension rod stabilizers.
Figure 8:
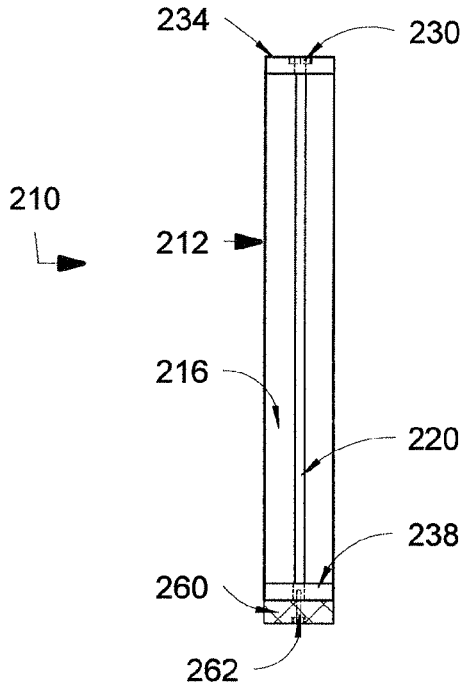
FIG. 8 depicts a side elevation view of the support assembly shown in FIG. 7.
Figure 9:
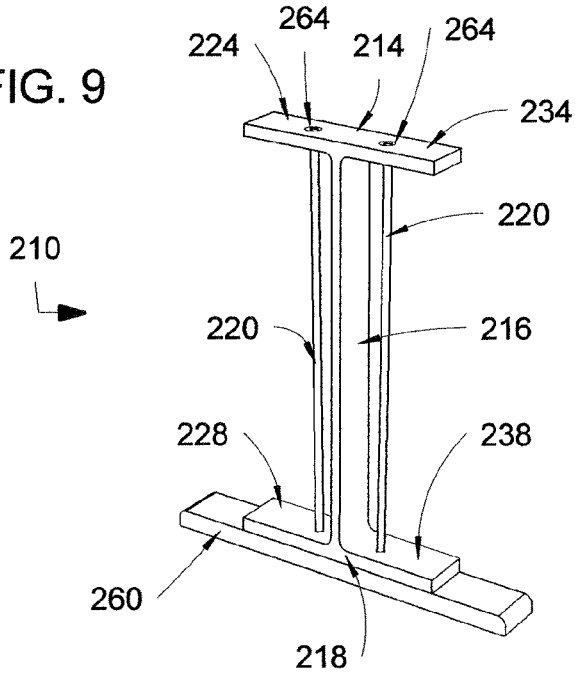
FIG. 9 depicts a perspective view of the support assembly shown in FIG. 7.

Referring to the drawings, FIGS. 7-9 depict a third embodiment of a vertical support structure 210 of the present invention. In this embodiment, vertical support 210 differs from the second embodiment in that the bottom flanges 228, 238 of the beam segment 212 has a full width of approximately 12 inches, comparable to the upper flanges 224, 234. Further, the height of the aluminum floor support 260 is less thick and has a different profile. A comparable bolted attachment is used to fasten the floor support 260 to the bottom flanges 228, 238 of the bottom section 218, however, 5/16-inch bolts 262 are a positioned farther away from the center section 216. Since the width of the flanges 228, 238 are not cut or otherwise reduced, the support foot 260 and flanges 228, 238 are subjected to reduced bending forces and can thus be fabricated from aluminum stock having a reduced flange thickness (i.e., height or sectional depth). Because the support foot 260 is not as thick, it need not be tapered and can be milled with a bull-nose or half-bull nose ends. To be able to counter even grater transverse forces that tend to laterally topple the vertical support 210, the support foot 260 can be extended further outward from the axial center. As in the second embodiment, 7/16-inch tie rods 220 are utilized and threaded on both ends thereof. The tension rods 220 thread into apertures 268 in the bottom flanges 228, 238 of the beam segment 212 and are tensioned by nuts 230 at the top surface 244 of the top section 214 or within canted apertures 264 within the upper flanges 224, 234.

Although three different embodiments of the vertical support 10, 110, 210 are presented above, it should be understood that a number of features of the first embodiment may be incorporated into the second and/or third embodiments without departing from the spirit and scope of the present invention. For example, while the tension rods 120, 220 of the second and third embodiments of the vertical support 110, 210 are canted, it should be understood that canted rods may likewise be incorporated into the first embodiment as well. Likewise, one or more tapered flanges 24, 34, 28, 38 may be incorporated into the second and third embodiments of the present invention.

Figure 10:
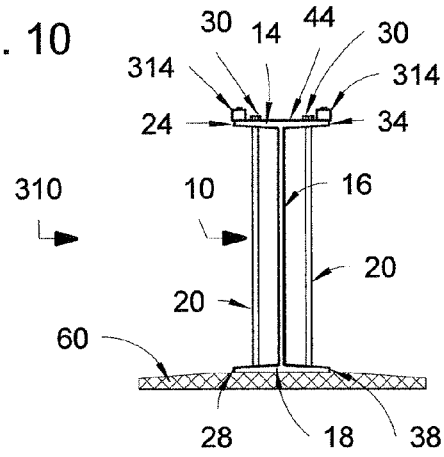
FIG. 10 depicts a front (and back) elevation view of a preferred embodiment of a trestle assembly in the form of a table frame incorporating two of the vertical support assemblies which are shown in FIGS. 1 through 3, and stretcher bars secured thereto.
Figure 11:
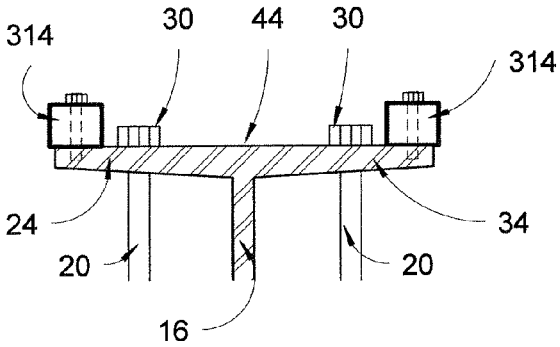
FIG. 11 depicts an enlarged front (and back) elevation view of the upper portion of the preferred embodiment of the trestle assembly shown in FIG. 10.
Figure 12:
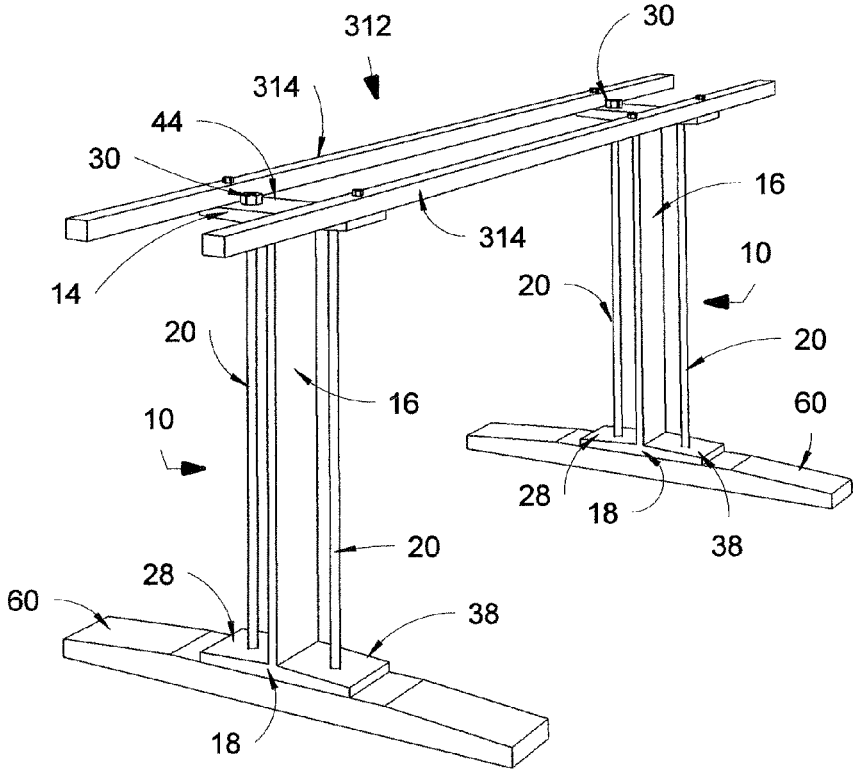
FIG. 12 depicts a perspective view of the preferred embodiment of the trestle assembly shown in FIG. 10.

FIGS. 10-12 depict a preferred embodiment of a trestle assembly 310 in the form of a table frame 312 incorporating two of the vertical supports 10 which are shown in FIGS. 1 through 3 and as described above. Each of the vertical supports 10 are joined to one another by two stretcher bars 314. The vertical support assemblies 10 are oriented relative to one another with their center sections 16 in line along the length of the trestle assembly 310. The stretcher bars 314 are preferably comprised of steel and are bolted to the upper surface 44 of the top section 14 of each of the vertical supports 10. The stretchers bars 314 bridge the distance between and extend beyond the ends of the vertical supports 10 along the long axis of the trestle assembly 310, forming a rigid unitary structure. The bolted connections are effectuated in the same or similar fashion as the floor support 60 is fastened to the lower flanges 28, 38 of the bottom section 18. In this embodiment and as shown most clearly in FIG. 11, hardened 5/16-inch bolts pass through apertures 364 in the stretcher bars 314 and are threaded into the upper flanges 24, 34 approximately ½-inch further outward from the center of the respective flanges 24, 34. Because a rigid connection is achieved once the stretcher bars 314 are secured to the vertical supports 10, no additional bracing is required for stability in the axial orientation. To achieve greater strength and to minimize the height and thickness of the connecting stretcher bars 314, steel or high-strength aluminum is preferably employed in connection with this embodiment. The height and width of these bar sections 314 are optimally 1 inch and 1¼ inches, respectively.

Figure 13:
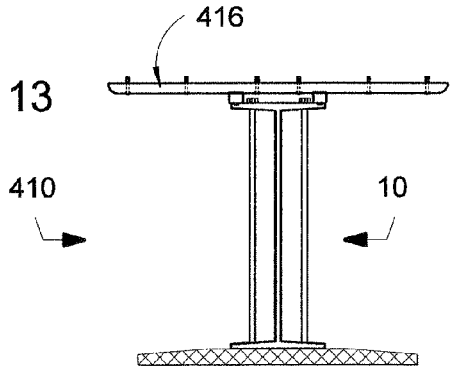
FIG. 13 depicts a front (and back) elevation view of the preferred embodiment of a trestle assembly in the form of a table frame incorporating two vertical support assemblies and stretcher bars as shown in FIG. 10, further having transverse support bars secured to the stretcher bars.
Figure 14:
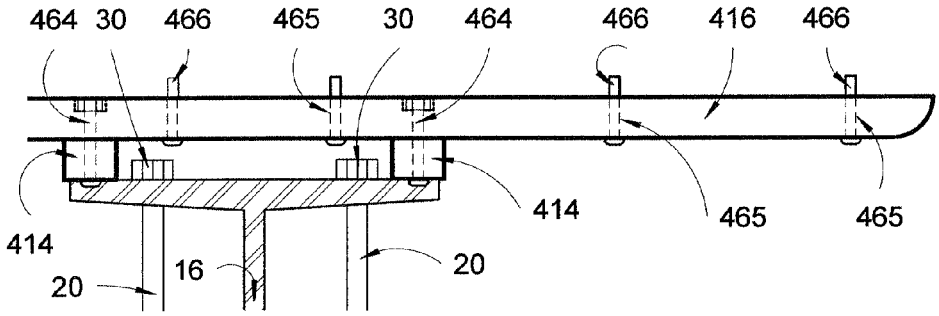
FIG. 14 depicts an enlarged front (and back) elevation view of the upper portion of the preferred embodiment of the trestle assembly shown in FIG. 13.
Figure 15:
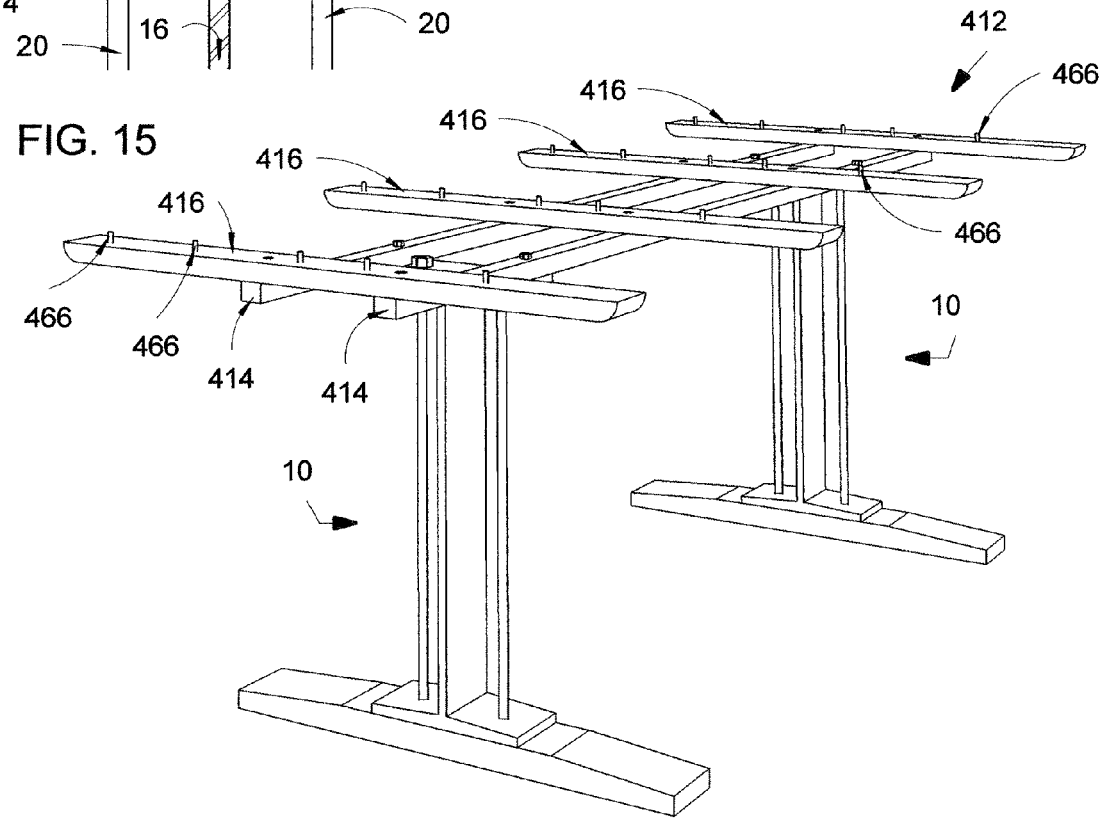
FIG. 15 depicts a perspective view of the preferred embodiment of the trestle assembly shown in FIG. 13.

FIGS. 13-15 depict another preferred embodiment of a trestle assembly 410 in the form of a table frame 412 incorporating two of the vertical supports 10 which are shown in FIGS. 1 through 3. The main distinction between the trestle assembly 410 and that shown in FIGS. 10-12, is the addition of transverse support bars 416 atop the stretcher bars 414. In this embodiment, four transverse support bars 416 are provided and bolted to the top surface of each of the two stretcher bars 414. The transverse bars 416 are perpendicularly oriented relative to the stretcher bars 414 and are preferably spaced at equal intervals with two of the transverse bars 416 positioned at each of the respective ends of stretcher bars 414. The transverse bars 416 extend a moderate distance beyond the lateral edges of the stretcher bars 414 but preferably several inches less than the edge of a given planar table top surface (not shown) that they directly support. The transverse bars 416 can be formed of hardwood or, for greater strength, high-strength aluminum such as 6061-T6 or steel. Preferably, the transverse bars 416 are through-bolted to the stretcher bars 414 with ¼-inch bolts 464 that are counter-sunk into the top surface of the transverse bars 416, creating a flush top surface on which the table top may rest. Optionally, along the length of each transverse bar 416, apertures 465 are provided through which screws or bolts 466 thread into and secure a table top from below. The number and placement of these bolts 466 may vary depending on the nature of the table top material and size of the surface.

Figure 16:
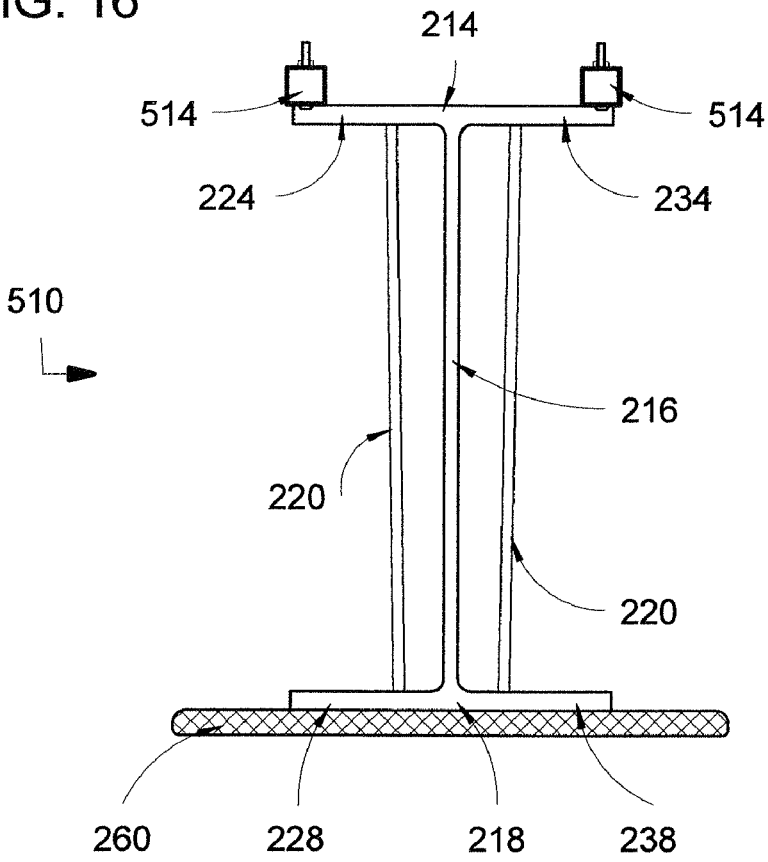
FIG. 16 depicts a front (and back) elevation view of a second embodiment of a trestle assembly in the form of a table frame incorporating two of the vertical support assemblies which are shown in FIGS. 7 through 9, and stretcher bars secured thereto.
Figure 17:
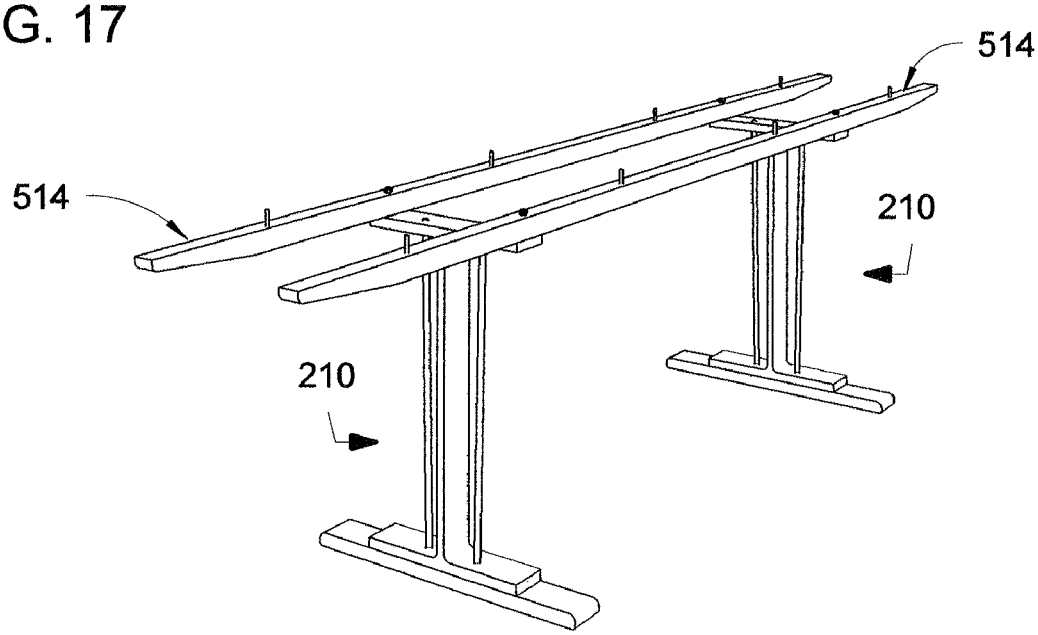
FIG. 17 depicts a perspective view of the second embodiment of the trestle assembly shown in FIG. 16.

FIGS. 16 and 17 depict a third embodiment of a trestle assembly 510 incorporating two vertical supports 210 of FIGS. 7-9. In this embodiment of the trestle assembly 510, the stretcher bars 514 have larger cross-sectional dimensions, longer lengths and different profile shapes. Preferably, the stretcher bars are fabricated from high strength 6061-T6 aluminum square stock. The stretcher bars 514 are bolted to the top flanges 224, 234 of the vertical support 210 with 5/16-inch bolts. The bolts pass through apertures 564 in the stretcher bars 514 and through threaded holes in the top flanges 224, 234. In this embodiment, the stretcher bars 514 are bolted at the ends of the top flanges 224, 234 which have a width greater than the corresponding flanges 24, 34 of the first vertical support 10. Thus, the distance between the parallel stretcher bars is increased and a stable support surface may be formed without the use of transverse bars. Utilizing the vertical support 210, steel stretcher bars of reduced height may support transverse bars that in turn may efficiently support a relatively wider table top surface.

Although three different embodiments of a trestle assembly 310, 410, 510 are presented above, it should be understood that a number of features of the first embodiment may be incorporated into the second and/or third embodiments without departing from the spirit and scope of the present invention. For example, while some of the embodiments lack transverse bars, those embodiments may be adapted to incorporate transverse bars. Likewise, while some of the trestle assemblies incorporate specified embodiments of the vertical support, other vertical supports that are specifically disclosed herein, or variations thereof, may be fabricated as well without departing from the spirit and scope of the invention.

A vertical support 10, 110, 210 and the trestle assemblies 310, 410, 510 constructed therefrom may be produced by providing a standard I-beam or wide-flange I-beam of sufficient length and preferably a number of feet long. The beam is cut into relatively short segments having a length of approximately 4½ inches or 3 inches as specified above, or any other suitable length for producing a beam segment. Preferably, however, the length dimension of each segment is less than or equal to the width dimension defined by the lateral edges of at least one pair of flanges of the beam segment. Cutting may be accomplished by conventional cutting means well known to a person skilled in the art. After a beam segment is formed, stabilizing means, such as threaded steel tension ties or rods, are provided between at least one, and preferably both, of the upper flanges and correspondingly positioned lower flanges, which are appropriately bored and/or threaded, to inhibit bending of said upper flanges and said lower flanges and the center section of the beam segment. Thereafter, the tension rods are secured between the upper and lower flanges with nuts or other conventional securing means. Of course, stretcher bars and transverse bars, as well as a planar surface may be optionally provided and attached to the vertical support to form a trestle assembly of the present invention.

As an alternative to producing the beam segments by cutting standard long I-beams into relatively shorter segments, an I-beam segment may be cast by conventional casting means well known to a person skilled in the art. Preferably, each I-beam segment is cast in the form of the I-beam segment specified above wherein the length dimension of each segment is less than or equal to the width dimension defined by the lateral edges of at least one pair of flanges of the beam segment. After the beam segment is cast, stabilizing means may be provided in a similar manner as mentioned above. Alternatively, the stabilizing means, such as long rods positioned between correspondingly positioned upper flanges and lower flanges may be cast as part of the overall beam segment, saving an extra manufacturing step.

Although the invention is described in terms of particular embodiments, it is to be understood that the embodiments are merely illustrative of an application of the principles of the invention. Numerous modifications may be made and other arrangements may be devised without departing from the spirit and scope of the invention.

The invention claimed is:

1. An improved I-beam support structure comprising:

an I-beam segment having a center section, a pair of lower flanges and pair of upper flanges connected by said center section, said pair of upper flanges including a first pair of edges located opposite one another that define a width dimension of said I-beam segment, and a second pair of edges located opposite one another that define a length dimension of said I-beam segment; and stabilizing means, comprising a tension rod canted relative to said center section, said stabilizing means positioned between at least one of said pair of lower flanges and one of said pair of upper flanges to inhibit bending of said I-beam segment.

2. The improved I-beam support of claim 1, wherein said width dimension is greater than or equal to said length dimension.

3. The improved I-beam support of claim 1, said I-beam segment comprising steel.

4. The improved I-beam support of claim 1, said tension rod comprising steel.

5. An improved I-beam support structure comprising:

an I-beam segment having a center section, a pair of lower flanges and pair of upper flanges connected by said center section, said pair of upper flanges including a first pair of edges located opposite one another that define a width dimension of said I-beam segment, and a second pair of edges located opposite one another that define a length dimension of said I-beam segment;

stabilizing means positioned between at least one of said pair of lower flanges and one of said pair of upper flanges to inhibit bending of said I-beam segment; and a support foot, said support foot being connected to said pair of lower flanges and forming an increased resting surface area.

6. An upright structural support comprising:

a top section having a first exterior surface;

a bottom section having a second exterior surface, said first exterior surface and said second exterior surface being horizontally oriented and parallel to one another;

a center section connecting said top section and said bottom section, said center section being generally perpendicular to at least one of said first exterior surface and said second exterior surface; and a stabilizer having a tension rod canted relative to said center section;

wherein said stabilizer inhibits bending of said first surface and said second surface, and extends between said top section and said bottom section.

7. The structural support of claim 6, further comprising securing means, said securing means selectively securing said stabilizer between said top section and said bottom section.

8. The structural support of claim 7, said securing means comprising a nut, wherein said at least one of said top section and said bottom section are tightened between said nut and said stabilizer.

9. The structural support of claim 6, said bottom section being fastened to a base having a length dimension and a width dimension that are respectively greater than those of said bottom section.

10. The structural support of claim 6, wherein at least one of said top section and said bottom section is generally triangular.

11. The structural support of claim 6, said top section and said bottom section each having two ends located opposite one another and a middle area between said two ends, wherein at least one of said top section and said bottom section has a height that is greater at said middle area than at said ends.

12. A structural support comprising:

a top section that extends in a first longitudinal direction such that said top section has a first longitudinal dimension and a first transverse dimension greater than said first longitudinal dimension;

a bottom section that extends in a second longitudinal direction such that said bottom section has a second longitudinal dimension and a second transverse dimension larger than said second longitudinal dimension;

a center section that extends vertically and connects said top section and said bottom section;

stabilizing bars positioned on each of two sides of said center section that inhibit bending of said structural support, said stabilizing bars extending between said top section and said bottom section.

13. The structural support of claim 12, wherein said top section, said bottom section and said center section comprise steel.

14. The structural support of claim 12, wherein said stabilizing bars comprise steel.

15. The structural support of claim 12, wherein said stabilizing bars are secured with a nut to at least one of said top section and said bottom section.

16. The structural support of claim 12, further comprising a support foot, said support foot being secured to said bottom section to increase stability.

17. The structural support of claim 12, wherein said bottom section has two ends and a middle area located between said ends, said ends and said middle area having a thickness that is greater at said middle area than at said ends.

18. The structural support of claim 17, said center section being connected to said bottom section at said middle area.

19. An improved table frame assembly comprising:

at least two vertical supports, each vertical support comprising an I-beam segment having a pair of lower flanges and a pair of upper flanges, said pair of upper flanges including a first pair of edges located opposite one another that define a width dimension of said I-beam, and a second pair of edges located opposite one another that define a length dimension of said I-beam segment;

at least one support rod positioned between one of said pair of lower flanges and one of said pair of upper flanges of each of said vertical supports to inhibit bending of said I-beam segment; and a support base, said base being connected to said pair of lower flanges.

20. The improved table frame assembly of claim 19, wherein said width dimension is greater than or equal to said length dimension.

21. The improved table frame assembly of claim 19, said vertical support comprising steel.

22. The improved table frame assembly of claim 19, further comprising a plurality of horizontal stretcher bars that are spaced apart from each other and span a distance between said vertical supports.

23. The improved table frame assembly of claim 22, further comprising a plurality of transverse bars positioned atop of and bolted on said stretcher bars.

* * * * *